United States Patent [19]

Mentzel et al.

[11] Patent Number: 4,945,932

[45] Date of Patent: Aug. 7, 1990

[54] CIGARETTE WHICH GOES OUT RAPIDLY OR IS SELF-EXTINGUISHING

[75] Inventors: Edgar Mentzel, Quickborn; Wolfgang Wildenau, Bargfeld-Stegen, both of Fed. Rep. of Germany

[73] Assignee: H. F. & ph. F. Reemtsma GmbH & Co., Fed. Rep. of Germany

[21] Appl. No.: 301,113

[22] Filed: Jan. 25, 1989

[30] Foreign Application Priority Data

Jan. 29, 1988 [DE] Fed. Rep. of Germany ..... 3802645

[51] Int. Cl.[5] ..... A24D 1/02

[52] U.S. Cl. ..... 131/365; 131/349

[58] Field of Search ..... 131/365, 349

*Primary Examiner*—V. Millin

*Attorney, Agent, or Firm*—Eric P. Schellin

[57] ABSTRACT

There is disclosed a cigarette which extinguishes rapidly wherein the tobacco in the cigarette is surrounded by a casing of cigarette paper having areas with lesser and greater air permeability in the form of patterned annular zones.

11 Claims, No Drawings

CIGARETTE WHICH GOES OUT RAPIDLY OR IS SELF-EXTINGUISHING

BACKGROUND OF THE INVENTION

1. Field of the Invention

This invention relates to cigarettes which go out rapidly or are self-extinguishing, whose tobacco is surrounded by a casing of cigarette paper comprising areas with lesser and greater air permeability in the form of patterned, preferably annular zones.

2. Prior Art

Such cigarettes are already known from DE-OS; 25 59 071 in which the cigarette paper exhibit zones of lesser porosity in a range up to 100 and zones of greater porosity in a zone of 150 to 2000 at an average porosity of 50 to 500 units, which units are determined in $cm^3$ $min^{-1}$/per 10 $cm^2$ and at a pressure of 10 cm water column. In these known cigarettes, a controlled burning speed and/or an increased number of puffs should be rendered possible by means of the annular zones of alternating porosity.

Instead of the porosity, the air permeability P is now indicated according to DIN ISO/DIS 2965.2 as the amount of air in $cm^3$ per minute, per $cm^2$ and per kiloPascal; it is calculated from the ratio of the volumetric current of air in $cm^3$/min which passes through the test specimen to the product of test surface of the test specimen in $cm^2$ and of the pressure difference between the two surfaces of the test specimen in kPa and was also indicated earlier as the so-called "Coresta value". The ISO/DIS 2965.2 was promulgated by the International Organization for Standardization and is incorporated herein by reference in its entirety.

Accordingly, a cigarette paper is used in accordance with DE-OS 25 59 071 whose areas of lesser porosity correspond to an air permeability value of up to 10 P and preferably 5 P whereas the areas of greater porosity exhibit a value of 15 to 200 P at a total porosity of this cigarette paper of 5 to 50 P. The reduction of the porosity in the areas of lesser porosity can be achieved according to the literature in paper with a high porosity by the application of gel-forming agents such as glue, methyl cellulose, gums or also lacquers and varnishes; the cigarette papers cited in it as being slightly porous with a porosity of approximately 3.6 P can also be perforated electrostatically or by pressure rollers or marking presses in order to achieve zones of greater porosity, in which instance the average porosity is approximately 24 P. The smouldering rates of one of these known cigarettes in e.g. around 3.2 mm/min at a puff number of 9.7 whereas the corresponding reference cigarette with customary paper with an average porosity of approximately 26 P exhibits a higher smouldering or burn rate of 4.2 mm/min and a lower draw number of 7.5.

Furthermore, DE-OS 23 15 613 teaches that the porosity of the paper can be reduced in its thickness by abrading in order to increase the permeability or the porosity of the paper. This purportedly makes it possible to affect the taste of the cigarette in an especially advantageous manner and not to weaken the structure of the cigarette paper by perforations.

Moreover, DE-PS 17 61 500 teaches that compressed areas in the form of a gridlike or wafflelike pattern consisting e.g. of a silicate pulp can be provided and the intersection points can be reinforced with a noncombustible substance in order in particular to prevent the ash from falling off.

Moreover, U.S. Pat. No. 3,911,923 teaches the use of cigarette papers whose porosity is increased in the direction of the mouthpiece in order to shape the supply of smoke in a more uniform manner.

All these known suggestions do result, to the extent that they can be realized technically at all, in certain advantages; however, these advantages are achieved at the expense of other desirable qualities. The increase of the porosity by means of electrostatic perforation raises the puff gradient, that is, the amount of smoke per puff, from the first to the last puff in a disadvantageous manner during smoking. If the porosity is reduced by means of the application of noncombustible substances or gelatins, pyrolysis products or undesirable combustibles are supplied to the smoker.

In addition, none of these suggestions has the result that the incandescent zone of the cigarette goes out by itself after a set time.

As regards the considerable danger of an accident created by cigarettes which have been set down, thrown away or which fell down when the smoker goes to sleep and continue to smoulder, the suggestion was made in the past, e.g. in accordance with U.S. Pat No. 4,061,147, that several separate sections consisting of noncombustible material such as e.g. aluminum foils be provided in a cigarette paper which can be torn off area by area in these areas at a selected breaking point. Aside from the fact that the manufacture of such cigarettes with aluminum foils on a paper base which foils can be torn off is quite expensive, such cigarettes exhibit a completely insufficient draw behavior and a considerable reduction in quality.

OBJECT OF THE INVENTION

The invention therefore has the problem of suggesting a cigarette whose incandescent zone goes out automatically after a smouldering time without a puff of less than approximately 210 seconds or after a burning off of less than 6 mm. Furthermore, the cigarette should also have less side stream smoke and the total behavior of the cigarette as regards the number of puffs and the smouldering speed should remain the same from charge to charge and correspond in all other qualities to customary cigarettes and, finally, the quality of the tobacco aroma which penetrates into the mouth should not be adversely affected.

SUMMARY OF THE INVENTION

A cigarette is therefore disclosed to solve this problem which comprises a cigarette paper of the type initially mentioned which cigarette is designed in accordance with the improvement embodied in the invention.

The unexpected fulfillment of the requirements of the problem is based on the recognition that two criteria are essential for the characterizing of customary cigarette papers and for the cigarettes made with them, to wit, the porosity or air permeability and also the smouldering rate or smouldering time. The porosity determines the degree of ventilation, the paper smouldering rate and the rapidity at which the cigarette smoulder dies down as well as determines, assuming standard smoking conditions, the rate of combustion and therewith the number of puffs. The porosity refers exclusively to the paper whereas a distinction must be made in the case of the smouldering rate between paper glow speed and cigarette glow speed.

Proportional but not linear relationships are present in traditional cigarette papers of the same base paper qualities. As the porosity rises, the smouldering rate rises also, whereas it drops as the porosity falls. A decrease of the smouldering rate is identical to an increase in the smouldering time. In the extreme case, a customary paper with zero porosity would no longer be capable of burning and the cigarette would go out immediately after being lit.

Multiple batonneing brings the porosity in the batonned areas to almost zero whereas the total porosity of the cigarette paper batonned in areas is under 4 P. This total porosity is considerably under the minimum values of customary cigarette paper and under those of the preferred, annular areas designated as slightly permeable in the state of the art which were considered to be the lower limit as regards their barely sufficient smouldering rate for maintaining a smokability acceptable to the consumer. The batonneing can occur on either side of the paper or on both sides.

Even though the zones compressed by the batonneing are preferably annular in shape, the formation of stamped zones along the cigarette axis, especially in the case of linear stamped zones, is technically simpler to manage on account of the control of the discrete zones to be multiply batonned since in the case of multiple batonneing transversally to the direction of travel of the cigarette paper there is the possibility that the stamping or embossing rollers will not exactly meet the previously stamped, identical, discrete area. This then results in the cigarette in a continuous smouldering rate in a longitudinally batonned cigarette paper instead of a discontinuous smouldering rate in a transversally batonned cigarette paper. However, this can be compensated for by a batonneing pattern in a zig-zag or corrugated shape. The advantage of a batonneing which takes place in a longitudinal direction is the avoidance of the formation of so-called smoulder bridges; an unevenness of the burning zone must be accepted but this is only optically disturbing.

The constancy of the smouldering speed of the cigarette paper batonned in accordance with the invention in the lower porosity range is especially unexpected. In general, the smouldering rate rises in customary cigarette paper as the porosity increases; however, the rise in the range of air permeability values up to 5 P corresponds to a very steep curve which does not merge into a proportionally rising straight line until at rather high P values. Since these values fluctuate from charge to charge in the case of customary cigarette paper with low air permeability, even slight changes of 1/10 P influence the smouldering speed considerably. On the other hand, if a cigarette paper is used with air permeability values of 15 P which have been reduced by batonneing to under 4 P, as is the case with the cigarette of the invention, the slight changes of the P values occasioned by the manufacture have practically no influence.

A further advantage of the cigarettes of the invention consists in the fact that a control of the cigarette qualities is achieved without additives to the tobacco or to the casing. Furthermore, the formation of the cigarette paper with compressed zones in accordance with the invention can be included in the manufacturing process of the paper and of the cigarette so that this measure for the control of the cigarette qualities can be carried out very economically.

The batonneing of cigarette paper is known per se and is e.g. mentioned in "Tobacco Encyclopedia" by E. Voges (1984) and takes place by embossing the paper on filigree calender. The paper is guided between or through the pressure nip of an embossing roll or embossing roller and a more resilient or elastic hard paper roller, the dry or semi-dry paper being compressed at the embossed points. As a result of this embossing of company or trademarks marks are embossed in and at these points the paper is denser and the embossed mark appears dark on a light background on the cigarette in plan view and light on a white background when viewed through the paper. The impression of an imitation watermark is obtained. The intensity of batonneing can be influenced by adjusting the absolute paper wetness in a range of approximately 1 to 10%, through the applied pressure of approximately 5 to 3000 Newton/cm and at different temperatures from room temperature to 95° C.

When batonneing cigarette paper, it is e.g. possible to use an embossing calender, which comprises an upper pressure roller, a back pressure roller below it and an embossing roller below it, a lower back pressure roller below it and a rigid lower pressure roller. The pressure rollers are usually steel rollers with a diameter of 32.0 cm and a working width of 119 cm. The back pressure rollers engaging with the embossing roller are paper-covered rollers with a diameter of 27.0 cm and a working width of 119 cm. The embossing roller is an engraved steel roller with a diameter of e.g. 19.4 cm and a working width of 118 cm, on whose circumference are provided circularly arranged, raised webs or grids which, as a function of the desired batonneing, e.g. have an individual width of 0.05 cm and a spacing of 0.05 cm. However, they can also lead to a different embossing between the webs or grids, if the webs or grids are made wider or higher. Generally the cigarette paper is drawn from a conventional unwiding device in a working width of 100 cm into the pressure gap between the embossing roller and the lower back pressure roller. By means of side regulation and paper guide rollers, the path is continuously controlled and, after batonneing, the paper is optionally wound with an interposed width stretching device. Winding generally takes place at a speed of 100 to 200 m/min, the drive of the roller combination being synchronized. Particularly good results are obtained at operating temperatures between 30 and 50° C. and a paper wetness of 5% to 7% absolute.

Batonneing of the cigarette papers can also take place during cigarette manufacture and is then carried out outside or directly in the cigarette making machine. The embossing calender can have a much smaller working width corresponding to the finished, cut-to-size cigarette paper, consequently being smaller and requiring lower operating pressures. In this case, the zone batonneing additional device is e.g. located between cigarette paper reels and the format finger of a conventional cigarette making machine, so that clock periods and controls of the cigarette paper to undergo batonneing can be more simply realized. The punch or cutting mechanism of the cigarette making machine can also be directly or synchronously coupled to the batonneing additional device.

DETAILED DESCRIPTION OF THE INVENTION

Example

Cigarettes with a cigarette paper with an initial air permeability of approximately 2.5 P (table A) and of approximately 6.6 P (table B) were set by multiple batonneing to a low total air permeability. The cigarette paper had a total fiber content of approximately 66% and a filler content of approximately 34% consisting essentially of calcium carbonate and a small amount of titanium oxide. Sodium acetate was added as a smouldering salt. As regards the areal weight of 25.0 g/m$^2$ and a thickness of approximately 35 μm, a glow salt content of 0.7% and an ash content of approximately 18%, this cigarette paper corresponded to the customary specifications.

This cigarette paper was batonned transversally to the direction of travel in zones of 0.4 mm width with an interval of 1 mm between zones.

The following tables show, as a function of the multiple batonneing, the drop in the air permeability, the self-extinguishing as smouldering rate in mm and in seconds without a puff in each instance as well as the average number of puffs in the case of two different cigarette papers.

The smouldering rate was not able to be determined in table A in seconds per 50 mm length of the cigarette because the cigarette went out after 27 mm already in the case of non-batonned paper and even after 6 to 1.5 mm in the case of batonned paper. In contrast thereto, these smouldering rate were able to be measured up to the second batonneing for the values of table B; the equivalent parameters, to wit, being self-extinguished in mm and in seconds were not able to be measured until after the third batonneing.

| | | ZONE BATONNEING CIGARETTE PAPER | | | | |
|---|---|---|---|---|---|---|
| | | Smouldering rate | | Extinguishing of the Cigarette | | |
| | Air permeability in P | Paper sec/150 mm | Cigarette sec/50 mm | mm | sec | No. of puffs n/50 mm |
| Table A | | | | | | |
| without | 2,46 | 69,4 | — | 27 | 701 | 9,3 |
| 1 × Batonne | 2,06 | 74,0 | — | 6 | 429 | 9,0 |
| 2 × Batonne | 1,95 | 78,9 | — | 1,5 | 217 | 9,7 |
| 3 × Batonne | 1,83 | 82,3 | — | 1,5 | 218 | 9,5 |
| 4 × Batonne | 1,78 | 87,4 | — | 2,5 | 170 | 9,8 |
| 5 × Batonne | 1,59 | 89,2 | — | 2,0 | 196 | 9,7 |
| Table B | | | | | | |
| without | 6,60 | — | 806 | — | — | 8,8 |
| 1 × Batonne | 5,38 | — | 919 | — | — | 8,6 |
| 2 × Batonne | 4,45 | — | 966 | — | — | 8,9 |
| 3 × Batonne | 3,70 | — | — | 2,0 | 167 | 8,3 |

The above values in table A clearly show a relatively constant decrease of the air permeability with the number of batonneing procedures, a considerable decrease of the smouldering rate corresponding to the number of batonneing passes and, unexpectantly, a non-differentiable puff number in spite of the customary spread in the case of hand-finished manufactured cigarettes. The self-extinguishing effect striven for within approximately 210 seconds is achieved here already after two batonneings.

The values in table B likewise show a clear decrease of the air permeability corresponding to the number of batonneing steps as well as a clear fall in the smouldering rate of the cigarette up to the self-extinguishing effect after the third batonneing step at a likewise very constant puff number.

We claim:

1. A cigarette that is rapidly self-extinguishing and having an incandescent zone that extinguishes after a smouldering time without a puff in less than about 210 seconds or after a burning off length of less than 6 mm, comprising a cigarette having a core of tobacco surrounded by a casing of paper, said casing of paper having areas with lesser and greater air permeability in the form of patterned zone wherein the casing of paper having an initial permeability of less than 15 P and an average total air permeability under 4 P as a result of at least a single batonneing to produce said patterned zones.

2. The cigarette according to claim 2, wherein the cigarette paper is batonned from an initial air permeability of 2 to 5 P to an average total air permeability of less than 2 P.

3. The cigarette according to claim 2, wherein the zones compressed by batonneing are annular in configuration.

4. The cigarette according to claim 3, wherein the annular zones compressed by batonneing are approximately 0.1 to 8 mm wide and exhibit intervals of 0.1 to 5 mm.

5. The cigarette according to claim 4, wherein the compressed, annular zones are approximately 0.3 to 0.5 mm wide and exhibit intervals of 1 mm.

6. The cigarette according to 4, wherein the stamped widths and the intervals of these batonned, annular zones exhibit different sizes on a cigarette.

7. The cigarette according to claim 6, wherein the stamped widths decrease with the same intervals toward the filter.

8. The cigarette according to claim 6, wherein the intervals increase with the same stamped widths toward the filter.

9. The cigarette according to claim 8, wherein the stamped zones are detailed in optionally interrupted lines, waves, rhombuses or zig-zags.

10. The cigarette according to claim 1, wherein the stamped zones are detailed in optionally interrupted lines, waves, rhombuses or zig-zags along the cigarette axis.

11. The cigarette according to claim 10, wherein the stamped zones are generated by batonneing the cigarette paper on both sides.

* * * * *